US010026390B2

(12) United States Patent
Zhang et al.

(10) Patent No.: US 10,026,390 B2
(45) Date of Patent: Jul. 17, 2018

(54) SOUND ABSORPTION PLATE WITH UNIT STRUCTURE

(71) Applicant: NANJING CHANGRONG ACOUSTIC INC., Jiangsu (CN)

(72) Inventors: Rongchu Zhang, Jiangsu (CN); Xiaoming Wen, Jiangsu (CN)

(73) Assignee: NANJING CHANGRONG ACOUSTIC INC., Jiangsu (CN)

( * ) Notice: Subject to any disclaimer, the term of this patent is extended or adjusted under 35 U.S.C. 154(b) by 0 days.

(21) Appl. No.: 15/576,702

(22) PCT Filed: Nov. 4, 2015

(86) PCT No.: PCT/CN2015/093811
§ 371 (c)(1),
(2) Date: Nov. 23, 2017

(87) PCT Pub. No.: WO2017/000454
PCT Pub. Date: Jan. 5, 2017

(65) Prior Publication Data

US 2018/0137852 A1 May 17, 2018

(30) Foreign Application Priority Data

Jun. 30, 2015 (CN) ..... 2015 1 0374021
Jun. 30, 2015 (CN) ..... 2015 1 0375761

(51) Int. Cl.
*F01N 1/08* (2006.01)
*G10K 11/178* (2006.01)
(Continued)

(52) U.S. Cl.
CPC ..... *G10K 11/178* (2013.01); *E04B 1/86* (2013.01); *E04B 9/045* (2013.01); *E04B 9/0464* (2013.01);
(Continued)

(58) Field of Classification Search
CPC ..... E04B 1/84; E04B 1/86; E04F 13/075
(Continued)

(56) References Cited

U.S. PATENT DOCUMENTS 5,492,195 A * 2/1996 Zink ..... F02C 7/24 181/264
6,041,125 A * 3/2000 Nishimura ..... G10K 11/172 381/71.1

FOREIGN PATENT DOCUMENTS

CN 201040885 3/2008
CN 202248342 * 5/2012 ..... E04B 1/84
(Continued)

OTHER PUBLICATIONS

"International Search Report (Form PCT/ISA/210)", dated Mar. 31, 2016, with English translation thereof, pp. 1-6.

*Primary Examiner* — Lao Lun-See
(74) *Attorney, Agent, or Firm* — JCIPRNET

(57) ABSTRACT

Disclosed is a sound absorption plate with a unit structure. The sound absorption plate comprises an ultramicropore sound absorption front plate (1), a side plate (2) and a sound absorption back plate (3). Edge parts of the ultramicropore sound absorption front plate (1) are connected to the sound absorption back plate (3) through the side plate (2), thereby forming a sound absorption resonant cavity (4). The material of the ultramicropore sound absorption front plate (1) is a metal material carrying nano microspheres (5). A sound absorption metal thin film (6) carrying nano microspheres (5), parallel to the ultramicropore sound absorption front plate, is disposed inside the sound absorption resonant cavity (4). A pore size of the nano microspheres in the ultramicropore sound absorption front plate (1) and the sound absorption metal thin film (6) is 100-1000 nm. The sound absorption plate has a simple structure, simple and convenient manufacture and assembly, a wide sound absorp-
(Continued)

tion frequency band and a good noise reduction effect, and is suitable for ceiling and wall decoration of buildings.

11 Claims, 6 Drawing Sheets

(51) Int. Cl.

| | |
|---|---|
| ***E04B 1/86*** | (2006.01) |
| ***E04B 9/04*** | (2006.01) |
| ***G10K 11/162*** | (2006.01) |
| ***H04R 17/00*** | (2006.01) |
| ***H04R 1/02*** | (2006.01) |
| *E04B 1/84* | (2006.01) |

(52) U.S. Cl.
CPC ..... *G10K 11/162* (2013.01); *H04R 1/028* (2013.01); *H04R 17/00* (2013.01); *E04B 2001/8461* (2013.01); *G10K 2210/3044* (2013.01)

(58) Field of Classification Search
USPC ..... 381/71.1–71.4, 71.7, 71.8, 72, 71.14; 181/206, 284, 294, 295
See application file for complete search history.

(56) References Cited

FOREIGN PATENT DOCUMENTS

| | | | | |
|---|---|---|---|---|
| CN | 102664002 | * | 9/2012 | ..... G10K 11/172 |
| CN | 203573642 | * | 4/2014 | ..... G10K 11/172 |
| CN | 20362070 | * | 6/2014 | ..... E04B 1/84 |
| CN | 203626070 | | 6/2014 | |
| CN | 102877564 | | 9/2014 | |
| CN | 104088421 | * | 10/2014 | ..... E04F 13/075 |
| CN | 104110813 | * | 10/2014 | ..... F24F 13/24 |
| CN | 204151706 | | 2/2015 | |
| JP | H10219871 | | 8/1998 | |
| JP | 2010007278 | | 1/2010 | |

* cited by examiner

SOUND ABSORPTION PLATE WITH UNIT STRUCTURE

CROSS-REFERENCE TO RELATED APPLICATION

This application is a 371 of international application of PCT application serial no. PCT/CN2015/093811, filed on Nov. 4, 2015, which claims the priority benefit of China application no. 201510374021.4, filed on Jun. 30, 2015, and China application no. 201510375761.X, filed on Jun. 30, 2015. The entirety of each of the above-mentioned patent applications is hereby incorporated by reference herein and made a part of this specification.

BACKGROUND OF THE INVENTION

1. Field of the Invention

The present invention relates to a sound absorption and noise reduction apparatus, and particularly to a sound absorption plate with a unit structure used for the interior of a building to eliminate a reverberant sound field.

2. Description of Related Art

In the modern city construction, requirements on indoor acoustic environments of large and medium-sized public buildings are getting higher and higher, and particularly for indoor decorative materials of large and medium-sized public buildings, both beautiful decorative features and excellent acoustic functions are required. However, conventional indoor decorative materials of large and medium-sized public buildings generally use aluminum strip-shaped, aluminum square-shaped or aluminum bracket-shaped ceilings and shingles and the like having micropores with a pore size of Φ 1-3 mm. Although these indoor decorative materials have certain sound absorption properties, actual sound absorption effects thereof are very poor, and cannot meet design requirements on indexes of indoor acoustic environment of modern large and medium-sized public buildings at all. In order to overcome defects of conventional ceilings and shingles, some modified ceiling and shingle products appear on the market currently, and sound absorption properties thereof are improved but still cannot reach satisfactory sound absorption effects.

Chinese patent application 201120333488.1 discloses "an ultramicropore sound absorber". The sound absorber includes a front plate provided with ultramicropores, and the front plate is formed into a rectangular body. A sound absorption oblique sheet carrying ultramicropores is provided within the rectangular body, and sealing cover plates are disposed at two ends of the rectangular body. The sound absorption oblique sheet may be a V-shaped sound absorption wedge. The sealing cover plates may carry ultramicropores or may not carry ultramicropores as needed. The ultramicropore sound absorber facilitates improvement of sound absorption properties, but still has the following shortcomings: the adoption of the sound absorption oblique sheet or the V-shaped sound absorption wedge changes the structure of an inner cavity, and a graduated cavity formed by the oblique sheet makes a sound absorption frequency band wider to a great extent; however, since a total sound absorption area in respective frequency ranges is reduced and accordingly, a sound absorption coefficient in respective frequency ranges tends to decrease as a whole, an average sound absorption coefficient is not high.

Chinese patent application 201320835639.2 discloses "a metal ultramicropore sound absorption hanging piece". The sound absorption hanging piece includes side plates and a support top plate, ultramicropores are disposed on the side plates, and the side plates and the support top plate define an inner cavity. A separator is disposed inside the inner cavity. Clamping edges are disposed on the side plates, and sealing cover plates are disposed at two ends of the inner cavity. The cross-sectional shape of the sound absorption hanging piece may be rectangular, semi-circular or wedge shaped. Different shapes of separators are disposed inside the cavity as needed, and sealing cover plates are disposed at two ends of the sound absorption hanging piece. The sound absorption hanging piece has better acoustic properties, but still has the following shortcomings: firstly, it is influenced by the product dimension, and has better sound absorption effect in middle and high frequencies and relatively poor sound absorption effect in a low frequency; and secondly, it has better sound absorption effect only in a specific range and has poor sound absorption effect in other frequency ranges, with a relatively narrower frequency band.

Chinese patent application 201410322266.8 discloses "a sound absorption plate". The sound absorption plate includes a sound absorption front plate, a sealed-type cavity sound absorption back plate and side edges. A set of ultramicropores are disposed on the sound absorption front plate, and the sealed-type cavity sound absorption back plate and the sound absorption front plate are connected to define a sealed-type cavity. The side edges for installation are disposed at rims of the sound absorption front plate. The sound absorption plate can utilize sheet resonance sound absorption of the sealed-type cavity sound absorption back plate to achieve better sound absorption effect without adding any fibrous material, but still has the following shortcomings: firstly, a specific disadvantage still exist that a sound absorption frequency band of a single-layer sound absorption plate is relatively narrower, and better sound absorption effect cannot be achieved in all frequency ranges in a wide frequency band range; and secondly, although sheet resonance sound absorption of the sealed-type sound absorption back plate is utilized, it is found through analysis by reference to the sheet resonance sound absorption theory from an overall installation structure that a dimension behind the sealed cavity is relatively large, the action of sound pressure energy is difficult to cause resonance of the sheet, so that resonance sound absorption effect of the sheet will be relatively limited.

Chinese patent application 201210398343.9 discloses "an environmental-friendly sound absorption wall with a sandstone plastered structure". The sound absorption wall is composed of seven layers and fixed on an original wall surface. A gas-permeable plate layer is disposed on a base layer, an epoxy resin adhesive layer is disposed on the gas-permeable plate layer, a cotton plate layer is disposed on the epoxy resin adhesive layer, a grid cloth layer is disposed on the cotton plate layer, a sandstone environmental-friendly sound absorption plate is disposed on the grid cloth layer, and a porous nano polymeric sand coating layer is disposed on the sandstone environmental-friendly sound absorption plate. The sandstone environmental-friendly sound absorption plate is plastered on the grid cloth after mixing 20-mesh to 100-mesh natural sands or natural color round sands with a bi-component water-soluble modified epoxy resin adhesive, with no seam in the entire wall surface; and then the porous nano polymeric sand coating layer is used to treat the wall surface, where the size of sands determines the number of pores, and different design schemes are adopted for different use sites. The sound absorption wall has better sound absorption effect than common walls, but still has the following shortcomings. Firstly, the porous nano polymeric sand coating layer is a particle coating formed by polymerizing nanoscale stone powder, having a particle size of 60 to 120 mesh (about 300-125 um), and since the sand dimension of the coating layer is large, a specific surface area of sand pores of the coating layer is small, thereby directly affecting improvement of the sound absorption effect. Secondly, although there are plenty of pores inside the particle coating layer, and the treated surface layer has a flow resistance value of 300 Pa·s/m-1000 Pa·s/m at a thickness of 2 mm and has good sound absorption effect, there still exist a deviation from a flow resistance value range reflecting the optimal sound absorption effect which is well-known in the art. Thirdly, since the sand dimension in the porous nano polymeric sand coating layer is large, the numbers of sands and pores both are small, thereby directly affecting absorption for high, middle and low sound frequencies. Fourthly, since there exists no sound absorption resonance cavity structure, it is difficult for sound energy to be effectively absorbed by the sound absorption wall surface, thereby directly affecting the sound absorption and noise reduction effect.

To sum up, how to overcome the shortcomings in the prior art has become one of the key problems to be solved in the art of sound absorption and noise reduction apparatuses.

SUMMARY OF THE INVENTION

The object of the present invention is to provide a sound absorption plate with a unit structure in order to overcome the shortcomings in the prior art. By applying extensions of comprehensive sound absorption means such as nano microsphere technique, the present invention has both advantages of a wide sound absorption frequency band and a good noise reduction effect, and advantages of a simple product structure, and convenient and reliable manufacture, assembly and use.

A technical solution A of a sound absorption plate with a unit structure of the present invention includes an ultramicropore sound absorption front plate, a side plate and a sound absorption back plate. Edge parts of the ultramicropore sound absorption front plate are connected to the sound absorption back plate through the side plate, thereby forming a sound absorption resonant cavity. It is characterized that the material of the ultramicropore sound absorption front plate is a metal material carrying nano microspheres. A pore size of the nano microspheres in the ultramicropore sound absorption front plate is 100-1000 nm.

A technical solution B of a sound absorption plate with a unit structure of the present invention further includes, based on the technical solution A, a sound absorption metal thin film carrying nano microspheres, which are disposed to be parallel to the ultramicropore sound absorption front plate and inside the sound absorption resonant cavity. A pore size of the nano microspheres in the sound absorption metal thin film is 100-1000 nm.

A technical solution C of a sound absorption plate with a unit structure of the present invention further includes, based on the technical solution B, a sound sensor and a speaker with a spectral analysis function disposed on the ultramicropore sound absorption front plate respectively. The sound sensor is in signal connection with the speaker with a spectral analysis function. The speaker with a spectral analysis function emits, according to a detection signal of the sound sensor, a sound wave having a phase opposite to a phase of a sound wave transmitted to the ultramicropore sound absorption front plate from an external environment, such that the positive and negative phases of the sound waves suffer from mutual cancellation.

The sound absorption principle of the present invention is that: the present invention further applies the "micro perforated front plate resonance sound absorption theory" of Mr Dah-You Maa and the sheet resonance sound absorption theory to construct a sound absorption resonant cavity by connecting an ultramicropore sound absorption front plate to a sound absorption back plate through a side plate, and expands the use of comprehensive sound absorption means such as nano microsphere technique. That is, the ultramicropore sound absorption front plate is modified to be an ultramicropore sound absorption front plate containing nano microspheres in an irregular dense arrangement, so as to achieve optimal sound absorption effect through an advantage that the ultramicropore sound absorption front plate has a porous structure and a large specific surface area. A further improvement of the present invention is to provide, in the sound absorption resonant cavity, a sound absorption metal thin film containing nano microspheres in an irregular dense arrangement, so as to facilitate elimination of a sound wave spectrum entering the sound absorption resonant cavity. Another further improvement of the present invention is to apply the superposition and cancellation principle of positive and negative phases of sound wave to modify the ultramicropore sound absorption front plate to be a device having self-balancing of sound absorption and production, so as to facilitate further improvement of the sound absorption effect by way of cancellation of positive and negative phases of sound wave. In the present invention, scanning electron microscopy of the nano microspheres in an irregular dense arrangement introduced in the materials of the ultramicropore sound absorption front plate and the sound absorption metal thin film reveals that: the nano microspheres have a diameter distribution in a range of 100-1000 nm, and the bodies of the nano microspheres all are a porous structure and have significant features of high porosity, good dispersibility and large specific surface area. Therefore, a key problem that the sound absorption properties of an existing sound absorption carrier are difficult to be further improved can be solved, and the sound absorption properties in high, middle and low sound frequencies of the sound absorption carrier are improved significantly.

Compared with the prior art, the present invention has the following significant advantages:

Firstly, the present invention creatively introduces nano microspheres in an ultramicropore sound absorption front plate and a sound absorption metal thin film so as to reach cooperative sound absorption with a sound absorption resonant cavity, thereby fundamentally solving shortcomings of existing technical solutions of sound absorption plates. Therefore, the present invention has excellent sound absorption properties with an average sound absorption coefficient in a frequency range of 125-4000 Hz of up to 0.8 or more and thus achieves better sound absorption effect.

Secondly, the nano microspheres adopted by the present invention has unique advantages of high porosity, good dispersibility and large specific surface area, and after the nano microspheres are introduced in the ultramicropore sound absorption front plate or the sound absorption metal thin film, the sound absorption properties of the sound absorption carrier are improved significantly, which makes a great contribution to improvement of the sound absorption properties in high, middle and low sound frequencies of a sound absorption plate in the art.

Thirdly, the present invention also applies, based on the introduction of the nano microspheres in the ultramicropore sound absorption front plate and the sound absorption metal thin film, the superposition principle of positive and negative phases of sound wave to further modify a sound absorption plate with a unit structure to be a device having self-balancing of sound absorption and production, so as to facilitate further improvement of the sound absorption effect by way of cancellation of positive and negative phases of sound wave, thereby expanding applications of the sound absorption plate with a unit structure of the present invention.

Fourthly, the sound absorption plate with a unit structure of the present invention has both advantages of a wide sound absorption frequency band and a good noise reduction effect and advantages of a simple structure, and convenient and reliable manufacture, assembly and use.

Fifthly, the sound absorption plate with a unit structure of the present invention applies to various places having high fire protection requirements and high cleaning requirements.

Sixthly, the sound absorption plate with a unit structure of the present invention applies to occasions where ceiling and wall decoration are required in various buildings, and specifically to occasions where strong sound absorption and noise reduction are required.

BRIEF DESCRIPTION OF THE DRAWINGS

FIG. 2-1 is a schematic view of the technical solution B of a sound absorption plate with a unit structure installed by using triangular keels, and FIG. 2-2 is a schematic view of the technical solution B of a sound absorption plate with a unit structure installed by using snap keels.

FIG. 5-1 is a schematic view of the technical solution C of a sound absorption plate with a unit structure using triangular keels, and FIG. 5-2 is a schematic view of the technical solution C of a sound absorption plate with a unit structure installed by using snap keels.

DESCRIPTION OF THE EMBODIMENTS

A detailed description of the present invention will be further given below in detail with reference to the accompanying drawings and embodiments.

Figure 1:
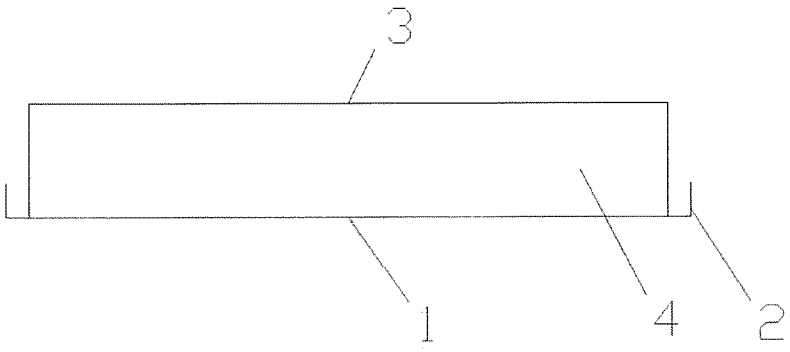
FIG. 1 is a schematic view of a technical solution A of a sound absorption plate with a unit structure installed by using triangular keels.
Figures 1, 2:
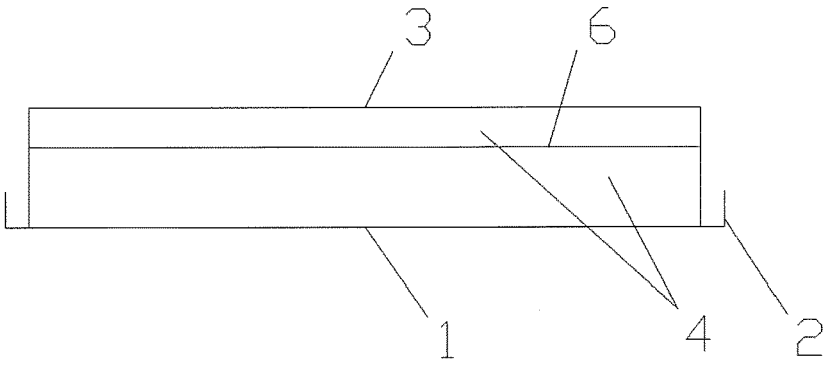
Figure 2:
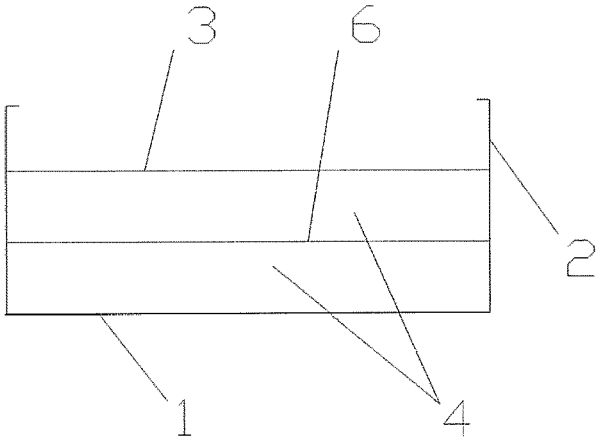
Figures 1, 5:
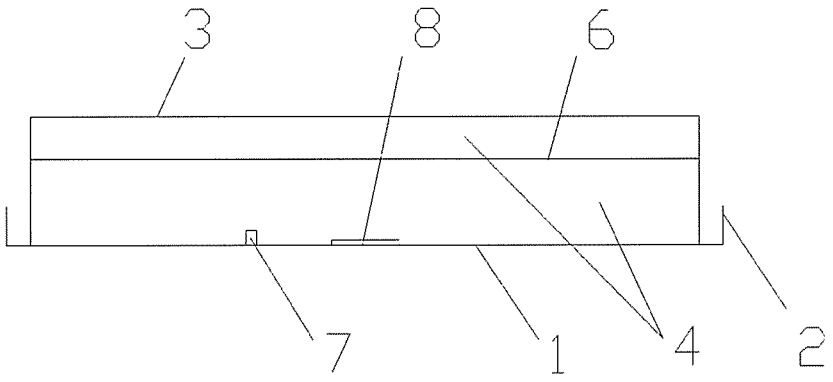
Figures 2, 5:
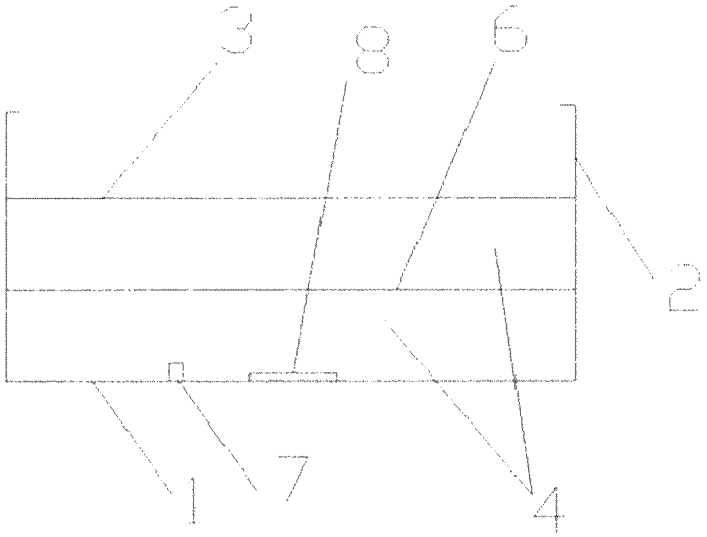
Figure 6:
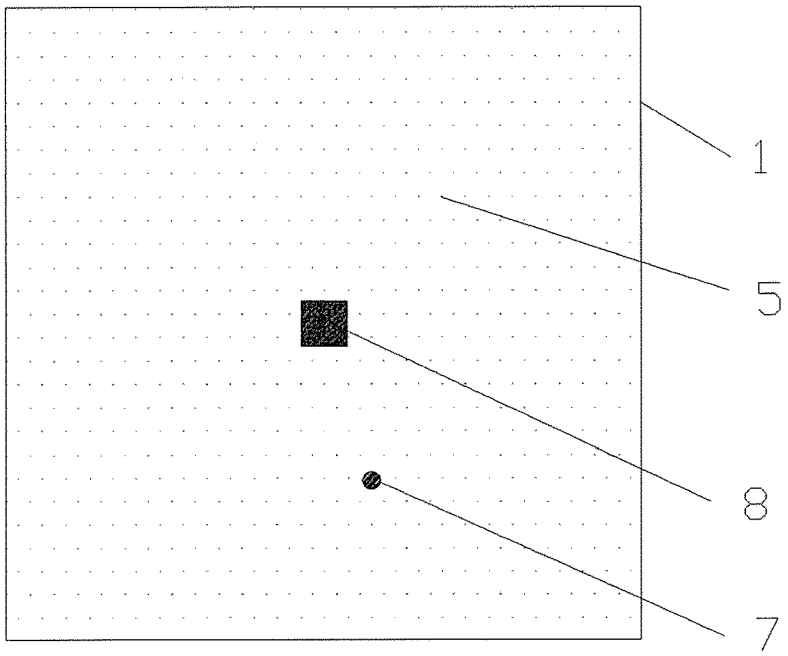
FIG. 6 is a schematic view of a structure of an ultramicropore sound absorption front plate in the technical solution C of a sound absorption plate with a unit structure, according to the present invention.
Figure 7:
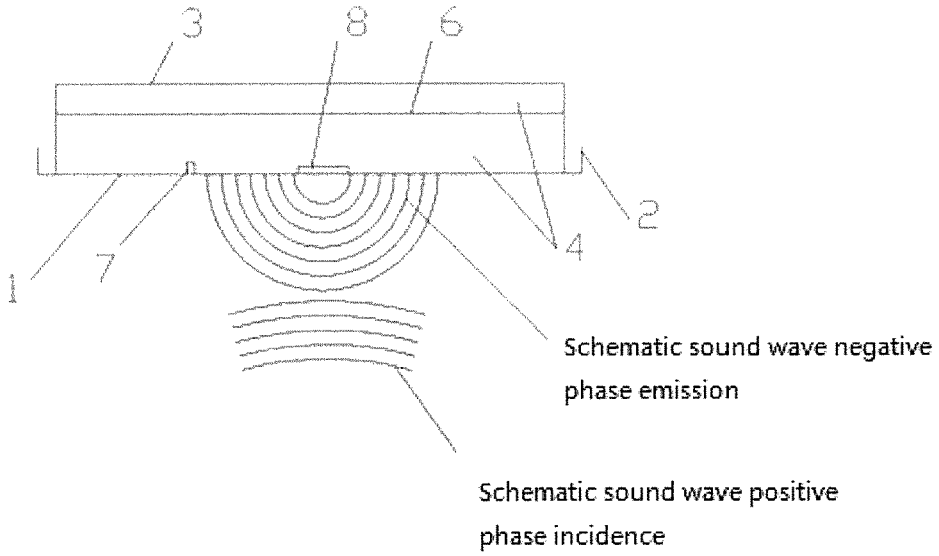
FIG. 7 is a schematic view of the superposition and cancellation principle of positive and negative phases of sound wave of the technical solution C of a sound absorption plate with a unit structure, according to the present invention.

With reference to FIGS. 1, 2 and 5, a technical solution A of a sound absorption plate with a unit structure of the present invention includes an ultramicropore sound absorption front plate (1), a side plate (2) and a sound absorption back plate (3). Edge parts of the ultramicropore sound absorption front plate (1) are connected to the sound absorption back plate (3) through the side plate (2), thereby forming a sound absorption resonant cavity (4). The material of the ultramicropore sound absorption front plate (1) is a metal material carrying nano microspheres (5). A pore size of the nano microspheres (5) in the ultramicropore sound absorption front plate (1) is 100-1000 nm. A technical solution B of a sound absorption plate with a unit structure of the present invention further includes, based on the technical solution A, a sound absorption metal thin film (6) carrying nano microspheres (5), which are disposed to be parallel to the ultramicropore sound absorption front plate and inside the sound absorption resonant cavity (4). A pore size of the nano microspheres (5) in the sound absorption metal thin film (6) is 100-1000 nm. A technical solution C of a sound absorption plate with a unit structure of the present invention further includes, based on the technical solution B, a sound sensor (7) and a speaker (8) with a spectral analysis function disposed on the ultramicropore sound absorption front plate (1) respectively. The sound sensor (7) is in signal connection with the speaker (8) with a spectral analysis function. The speaker (8) with a spectral analysis function emits, according to a detection signal of the sound sensor (7), a sound wave having a phase to opposite to a phase of a sound wave transmitted to the ultramicropore sound absorption front plate (1) from an external environment, such that positive and negative phases of the sound waves suffer from mutual cancellation.

Further preferred solutions of the technical solutions A, B and C of a sound absorption plate with a unit structure of the present invention as described above are that:

A pore size of ultramicropores in the ultramicropore sound absorption front plate (1) is 0.05-0.3 mm.

The nano microspheres (5) in the sound absorption metal thin film (6) or the ultramicropore sound absorption front plate (1) are in an irregular dense arrangement.

The material of the sound absorption metal thin film (6) carrying the nano microspheres (5) is aluminum foil or copper foil, with a thickness of 0.01-0.3 mm.

A cross-sectional area of the sound absorption metal thin film (6) carrying the nano microspheres (5) is equal to that of the sound absorption resonant cavity (4).

The material of either the ultramicropore sound absorption front plate (1) or the sound absorption back plate (3) is an aluminum alloy plate, a galvanized plate or a stainless steel plate, and the ultramicropore sound absorption front plate (1) and the sound absorption back plate (3) have the same thicknesses of 0.5-1.2 mm.

The sound sensor (7) is a SMD (surface mounted device) sound wave piezoelectric sensor, and converts sound wave pressure into an electrical signal and transfers the electrical signal to the speaker (8) with a spectral analysis function.

The speaker (8) with a spectral analysis function is a SMD piezoelectric speaker, and analyses a sound wave spectrum of an external environment to emit a sound wave spectrum having an opposite phase thereto.

In addition to the above solutions, the shape of the ultramicropore sound absorption front plate (1) may be a square shape, a rectangular shape, a long strip shape, a wave shape, a circular shape, or a diamond shape. The side plate (2) adopts triangular keels, snap keels or corner braces to be connected to edge parts of the ultramicropore sound absorption front plate (1) and the sound absorption back plate (3) respectively. A surface layer of the ultramicropore sound absorption front plate (1) is pressed with patterns for increasing the structural strength or the sound absorption effect.

The technical solutions A, B and C of a sound absorption plate with a unit structure of the present invention all apply to places having high requirements for sound absorption and noise reduction and decoration, such as high-speed rails, airports, sports venues, hospitals, theaters, recording studios, recording rooms, broadcasting studios, audition rooms, business office spaces, television stations, radio stations, multifunction halls, conference rooms, studios, music halls, auditoriums, large-scale entertainment centers, hotels, KTV, superior villas, cleaning plants, railway stations.

Specific embodiments of a sound absorption plate with a unit structure of the present invention are further described as follows.

Figure 3:
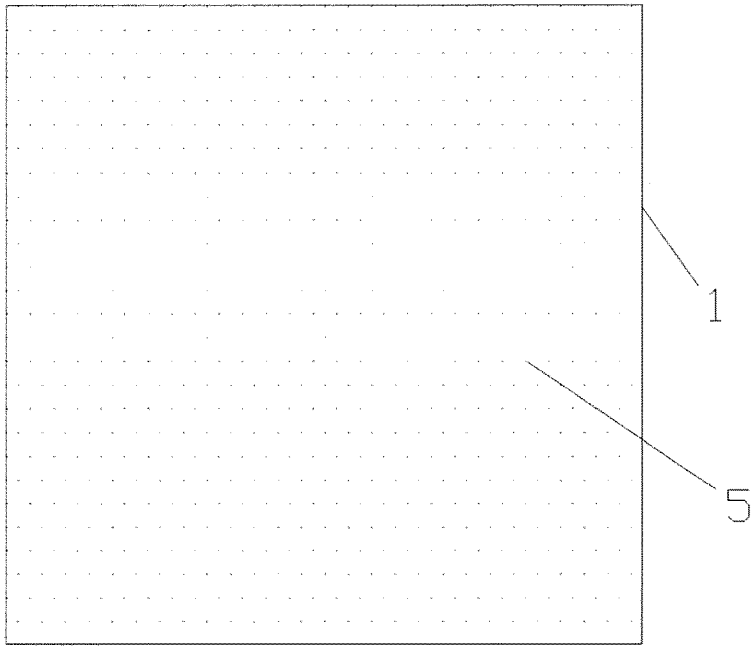
FIG. 3 is a schematic view of a structure of an ultramicropore sound absorption front plate in the technical solution A or B of a sound absorption plate with a unit structure, according to the present invention.
Figure 4:
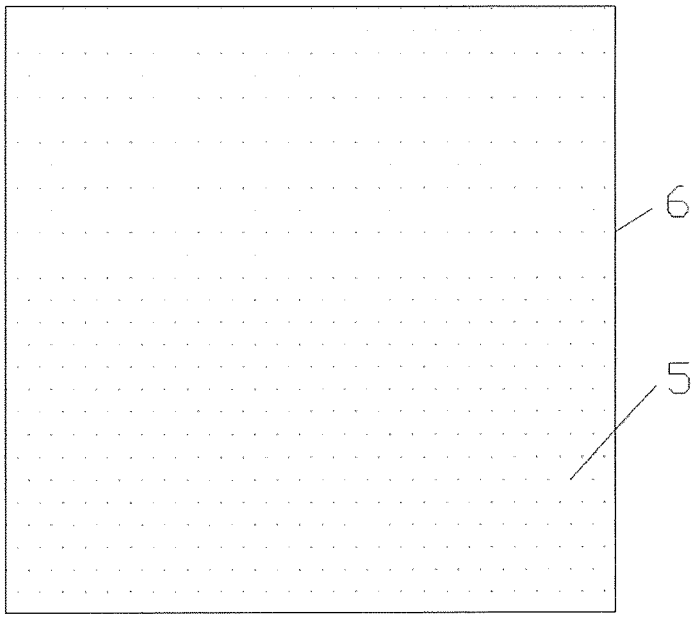
FIG. 4 is a schematic view of a structure of a sound absorption metal thin film carrying nano microspheres according to the present invention.
Figure 8:
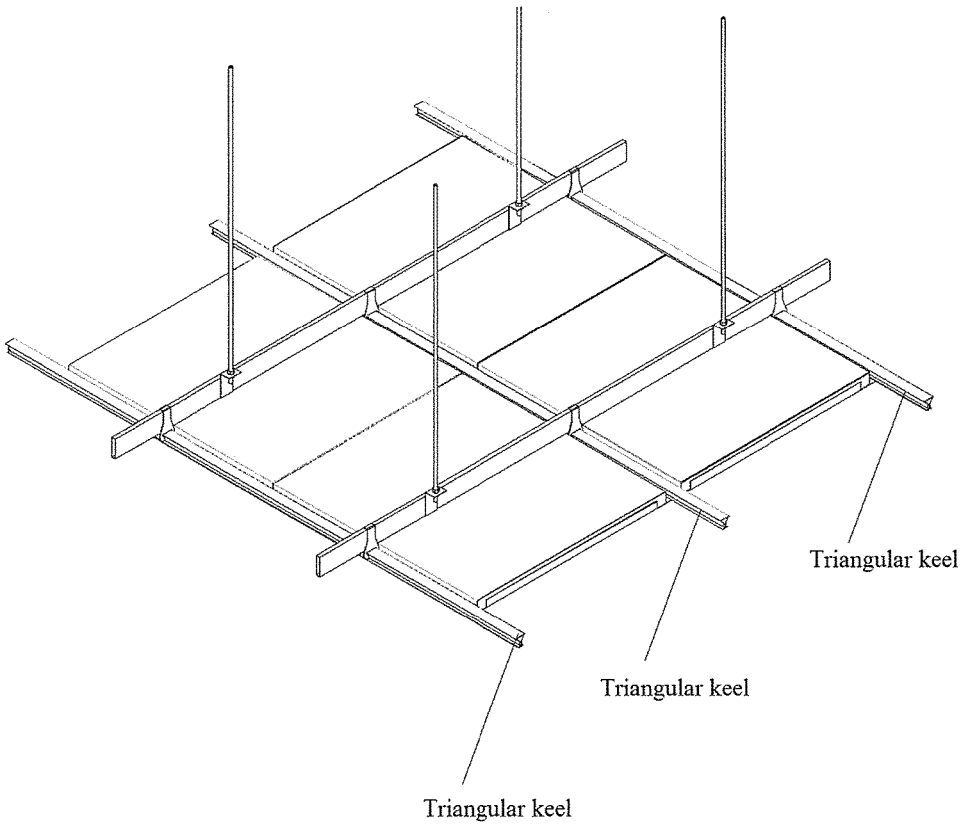
FIG. 8 is a schematic view of a structure of a sound absorption plate with a unit structure by combining seamless splicing installation and installation with triangular keels.
Figure 9:
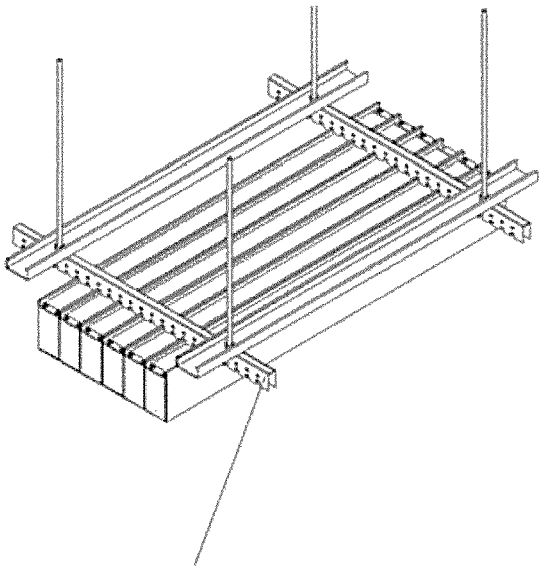
FIG. 9 is a schematic view of a structure of a sound absorption plate with a unit structure by combining seamless splicing installation and installation with snap keels.
Figure 10:
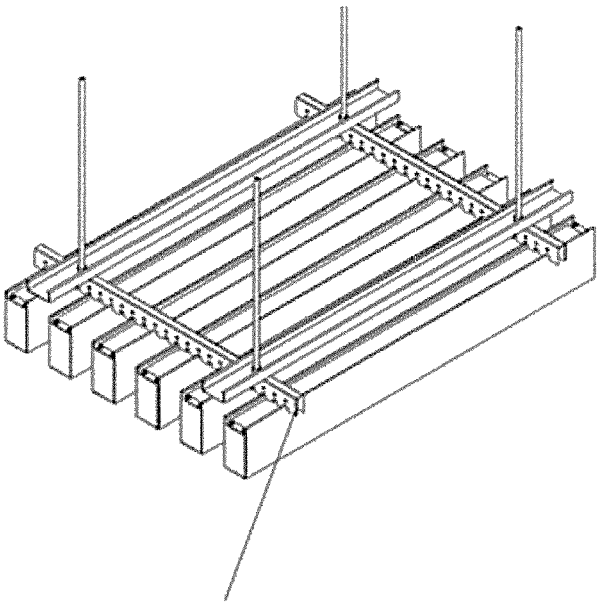
FIG. 10 is a schematic view of a structure of a sound absorption plate with a unit structure by combining interval installation and installation with snap keels.

Embodiment 1: in this embodiment, the sound absorption plate with a unit structure of the present invention is applied to a business office space, and specific description is made with reference to FIGS. 1, 3 and 8. A cross-sectional shape of the sound absorption plate with a unit structure of the present invention is as shown in FIG. 1, having a front plate dimension of 600×600 mm, a sectional dimension of 600×90 mm, and a height of 90 mm. The material of the ultramicropore sound absorption front plate (1) is aluminium alloy carrying nano microspheres (5), a thickness of the ultramicropore sound absorption front plate (1) is 0.5 mm, and a pore size of the nano microspheres (5) is 100 nm. A pore size of the ultramicropores in the ultramicropore sound absorption front plate (1) is 0.05 mm According to user's requirements, a part of the surface of the ultramicropore sound absorption front plate (1) may be pressed with patterns for increasing the structural strength and the sound absorption effect, and the patterns are star patterns or flower patterns. The side plate (2) available for installation is connected to the ultramicropore sound absorption front plate (1), a side height of the side plate (2) is 30 mm, and concave points and convex points available for installation and fixation of triangular keels are disposed on the side plate (2). The sound absorption back plate (3) is not perforated, and has a material of aluminium alloy and a thickness of 0.5 mm. The sound absorption resonant cavity (4) has a dimension of 580×580 mm and a height of 90 mm. The overall installation way of the sound absorption plate with a unit structure of the present invention adopts an existing well-known installation with triangular keels.

Embodiment 2: in this embodiment, the sound absorption plate with a unit structure of the present invention is applied to a business office space, and specific description is made with reference to FIGS. 4, 5-1, 6, 7 and 8. A cross-sectional shape of the sound absorption plate with a unit structure of the present invention is as shown in FIG. 1, having a material plate dimension of 600×600 mm, a sectional dimension of 600×90 mm, and a height of 90 mm. The material of the ultramicropore sound absorption front plate (1) is aluminium alloy carrying nano microspheres (5), a thickness of the ultramicropore sound absorption front plate (1) is 0.5 mm, and a pore size of the nano microspheres (5) is 100 nm. A pore size of the ultramicropores in the ultramicropore sound absorption front plate (1) is 0.05 mm. According to user's requirements, a part of the surface of the ultramicropore sound absorption front plate (1) may be pressed with patterns for increasing the structural strength and the sound absorption effect, and the patterns are star patterns or flower patterns. The side plate (2) available for installation is connected to the ultramicropore sound absorption front plate (1), a side height of the side plate (2) is 30 mm, and concave points and convex points available for installation and fixation of triangular keels are disposed on the side plate (2). The sound absorption back plate (3) is not perforated, and has a material of aluminium alloy and a thickness of 0.5 mm. The sound absorption resonant cavity (4) has a dimension of 580×580 mm and a height of 90 mm, and the sound absorption metal thin film (6) carrying nano microspheres (5), parallel to the ultramicropore sound absorption front plate, is disposed inside the sound absorption resonant cavity (4). The sound absorption metal thin film (6) has a material of aluminum foil, a thickness of 0.01 mm, and a sectional area equal to that of the sound absorption resonant cavity (4). A pore size of the nano microspheres (5) is 100 nm. The sound sensor (7) and the speaker (8) with a spectral analysis function are disposed on the ultramicropore sound absorption front plate (1) respectively. The sound sensor (7) is in signal connection with the speaker (8) with a spectral analysis function. The overall installation way of the sound absorption plate with a unit structure of the present invention adopts an existing well-known installation with triangular keels.

Embodiment 3: in this embodiment, the sound absorption plate with a unit structure of the present invention is applied for sound absorption and cleaning of an electronic production plant, and specific description is made with reference to FIGS. 2-2, 3, 4 and 9. A cross-sectional shape of the sound absorption plate with a unit structure of the present invention is as shown in FIG. 1, having a sectional dimension of 300×60 mm, and a length dimension of 4000 mm. The material of the ultramicropore sound absorption front plate (1) is aluminium alloy carrying nano microspheres (5), a thickness of the ultramicropore sound absorption front plate (1) is 1.2 mm, and a pore size of the nano microspheres (5) is 500 nm. A pore size of the ultramicropores in the ultramicropore sound absorption front plate (1) is 0.1 mm. The side plate (2) available for installation is connected to the ultramicropore sound absorption front plate (1), a side height of the side plate (2) is 60 mm, and folding edges available for installation and fixation of snap keels are disposed on the side plate (2), a width of the folding edge being 8 mm. The sound absorption back plate (3) is not perforated, and has a material of aluminium alloy and a thickness of 1.2 mm. The sound absorption resonant cavity (4) has a dimension of 298×3998 mm and a height of 60 mm, and the sound absorption metal thin film (6) with nano microspheres, parallel to the ultramicropore sound absorption front plate, is disposed inside the sound absorption resonant cavity (4). The sound absorption metal thin film (6) has a material of copper foil, a thickness of 0.2 mm, and a sectional area equal to that of the sound absorption resonant cavity (4). A pore size of the nano microspheres (5) is 500 nm. The overall installation way of the sound absorption plate with a unit structure of the present invention adopts an existing well-known installation with snap keels. When sound absorption plates with a unit structure are combined and assembled, two adjacent sound absorption plates with a unit structure adopt seamless splicing.

Embodiment 4: in this embodiment, the sound absorption plate with a unit structure of the present invention is applied to sound absorption wall surfaces and top surfaces of a station platform, and specific description is made with reference to FIGS. 2-2, 3, 4 and 10. A cross-sectional shape of the sound absorption plate with a unit structure of the present invention is as shown in FIG. 1, having a sectional dimension of 300×70 mm, and a length dimension of 5000 mm. The material of the ultramicropore sound absorption front plate (1) is stainless steel, a thickness of the ultramicropore sound absorption front plate (1) is 0.75 mm, and a pore size of the nano microspheres (5) is 1000 nm. A pore size of the ultramicropores in the ultramicropore sound absorption front plate (1) is 0.2 mm. The side plate (2) available for installation is connected to the ultramicropore sound absorption front plate (1), a height of the side plate (2) is 70 mm, and folding edges available for installation and fixation of snap keels are disposed on the side plate (2), a width of the folding edge being 8 mm. The sound absorption back plate (3) is not perforated, and has a material of stainless steel and a thickness of 0.75 mm. The sound absorption resonant cavity (4) has a dimension of 298×4998 mm and a height of 70 mm, and the sound absorption metal thin film (6) carrying nano microspheres (5), parallel to the ultramicropore sound absorption front plate, is disposed inside the sound absorption resonant cavity (4). The sound absorption metal thin film (6) has a material of aluminum foil, a thickness of 0.3 mm, and a sectional area equal to that of the sound absorption resonant cavity (4). A pore size of the nano microspheres (5) is 1000 nm. The overall installation way of the sound absorption plate with a unit structure of the present invention adopts an existing well-known installation with snap keels, the sound absorption plates with a unit structure are installed at intervals, and an interval between two adjacent sound absorption plates with a unit structure is 150 mm.

Embodiment 5: in this embodiment, the sound absorption plate with a unit structure of the present invention is applied to sound absorption surfaces of an industrial plant, and specific description is made with reference to FIGS. 4, 5-1, 6, 7 and 8. A cross-sectional shape of the sound absorption plate with a unit structure of the present invention is as shown in FIG. 1, having a material plate dimension of 600×600 mm, a sectional dimension of 600×70 mm, and a height of 70 mm. The material of the ultramicropore sound absorption front plate (1) is a galvanized plate, a thickness of the ultramicropore sound absorption front plate (1) is 1.0 mm, and a pore size of the nano microspheres (5) is 1000 nm. A pore size of the ultramicropores in the ultramicropore sound absorption front plate (1) is 0.3 mm. The side plate (2) available for installation is connected to the ultramicropore sound absorption front plate (1), a height of the side plate (2) is 30 mm, and concave points and convex points available for installation and fixation of the triangular keels are disposed on the side plate (2). The sound absorption back plate (3) is not perforated, and has a material of galvanized plate and a thickness of 1.0 mm. The sound absorption resonant cavity (4) has a dimension of 580×580 mm and a height of 70 mm, and the sound absorption metal thin film (6) carrying nano microspheres (5), parallel to the ultramicropore sound absorption front plate, is disposed inside the sound absorption resonant cavity (4). The sound absorption metal thin film (6) has a material of copper foil, a thickness of 0.08 mm, and a sectional area equal to that of the sound absorption resonant cavity (4). A pore size of the nano microspheres (5) is 1000 nm. The sound sensor (7) and the speaker (8) with a spectral analysis function are disposed on the ultramicropore sound absorption front plate (1) respectively. The sound sensor (7) is in signal connection with the speaker (8) with a spectral analysis function. The overall installation way of the sound absorption plate with a unit structure of the present invention adopts an existing well-known installation with triangular keels.

Embodiment 6: in this embodiment, the sound absorption plate with a unit structure of the present invention is applied for sound absorption cleaning of an electronic production plant, and specific description is made with reference to FIGS. 4, 5-2, 6, 7 and 9. A cross-sectional shape of the sound absorption plate with a unit structure of the present invention is as shown in FIG. 1, having a sectional dimension of 300×60 mm, and a length dimension of 4000 mm. The material of the ultramicropore sound absorption front plate (1) is aluminium alloy carrying nano microspheres (5), a thickness of the ultramicropore sound absorption front plate (1) is 1.2 mm, and a pore size of the nano microspheres (5) is 500 nm. A pore size of the ultramicropores in the ultramicropore sound absorption front plate (1) is 0.1 mm. The side plate (2) available for installation is connected to the ultramicropore sound absorption front plate (1), a height of the side plate (2) is 60 mm, and folding edges available for installation and fixation of snap keels are disposed on the side plate (2), a width of the folding edge being 8 mm. The sound absorption back plate (3) is not perforated, and has a material of aluminium alloy and a thickness of 1.2 mm. The sound absorption resonant cavity (4) has a dimension of 298×3998 mm and a height of 60 mm, and the sound absorption metal thin film (6) carrying nano microspheres (5), parallel to the ultramicropore sound absorption front plate, is disposed inside the sound absorption resonant cavity (4). The sound absorption metal thin film (6) has a material of copper foil, a thickness of 0.2 mm, and a sectional area equal to that of the sound absorption resonant cavity (4). A pore size of the nano microspheres (5) is 500 nm. The sound sensor (7) and the speaker (8) with a spectral analysis function are disposed on the ultramicropore sound absorption front plate (1) respectively. The sound sensor (7) is in signal connection with the speaker (8) with a spectral analysis function. The overall installation way of the sound absorption plate with a unit structure of the present invention adopts an existing well-known installation with snap keels. When sound absorption plates with a unit structure are combined and assembled, two adjacent sound absorption plates with a unit structure adopt seamless splicing.

Embodiment 7: in this embodiment, the sound absorption plate with a unit structure of the present invention is applied to sound absorption wall surfaces and top surfaces of a station platform, and specific description is made with reference to FIGS. 4, 5-2, 6, 7 and 10. A cross-sectional shape of the sound absorption plate with a unit structure of the present invention is as shown in FIG. 1, having a sectional dimension thereof of 300×70 mm, and a length dimension of 5000 mm. The material of the ultramicropore sound absorption front plate (1) is stainless steel, a thickness of the ultramicropore sound absorption front plate is 0.75 mm, and a pore size of the nano microspheres (5) is 1000 nm. A pore size of the ultramicropores in the ultramicropore sound absorption front plate (1) is 0.2 mm. The side plate available for installation is connected to the ultramicropore sound absorption front plate (1), a height of the side plate (2) is 70 mm, and folding edges available for installation and fixation of snap keels are disposed on the side plate (2), a width of the folding edge being 8 mm. The sound absorption back plate (3) is not perforated, and has a material of aluminium alloy and a thickness of 0.75 mm. The sound absorption resonant cavity (4) has a dimension of 298×4998 mm and a height of 70 mm, and the sound absorption metal thin film (6) carrying nano microspheres (5), parallel to the ultramicropore sound absorption front plate, is disposed inside the sound absorption resonant cavity (4). The sound absorption metal thin film (6) has a material of aluminum foil, a thickness of 0.3 mm, and a sectional area equal to that of the sound absorption resonant cavity (4). A pore size of the nano microspheres (5) is 1000 nm. The sound sensor (7) and the speaker (8) with a spectral analysis function are disposed on the ultramicropore sound absorption front plate (1) respectively. The sound sensor (7) is in signal connection with the speaker (8) with a spectral analysis function. The overall installation way of the sound absorption plate with a unit structure of the present invention adopts an existing well-known installation with snap keels, the sound absorption plates with a unit structure are installed at intervals, and an interval between two adjacent sound absorption plates with a unit structure is 150 mm.

The contents not specifically described in the detailed description of the present invention are known in the art and may be implemented with reference to known techniques.

The present invention has been verified via repeated tests, and satisfactory test results are achieved.

The specific embodiments and examples above are provided to support the technical concepts of a sound absorption plate with a unit structure of the present invention, and are not intended to limit the scope of protection of the present invention. Any equivalent modification or variations made based on the present technical solution following the technical concepts of the present invention, all fall within the scope of protection of the present invention.

What is claimed is:

1. A sound absorption plate with a unit structure, wherein the unit structure comprises:

an ultramicropore sound absorption panel, wherein the ultramicropore sound absorption panel is a metal plate carrying first nano microspheres and a pore size of the nano microspheres is 100-1000 nm;

a sound absorption back plate; and a side plate, wherein edge parts of the ultramicropore sound absorption panel are connected to the sound absorption back plate through the side plate to form a sound absorption resonant cavity.

2. The sound absorption plate of claim 1, wherein a pore size of the first nano ultramicropores of the ultramicropore sound absorption panel is 0.05-0.3 mm.

3. The sound absorption plate of claim 1, wherein the ultramicropore sound absorption panel and the sound absorption back plate independently are an aluminum alloy plate, a galvanized plate or a stainless steel plate, and the ultramicropore sound absorption panel and the sound absorption back plate have the same thicknesses of 0.5-1.2 mm.

4. The sound absorption plate of claim 1, wherein the unit structure further comprises:

a sound absorption metal thin film carrying second nano microspheres, wherein the sound absorption metal thin film is disposed in the sound absorption resonant cavity to be parallel to the ultramicropore sound absorption panel, and a pore size of the second nano microspheres is 100-1000 nm.

5. The sound absorption plate of claim 4, wherein the first and second nano microspheres are in an irregular dense arrangement.

6. The sound absorption plate of claim 4, wherein the sound absorption metal thin film is an aluminum foil or a copper foil, having a thickness of 0.01-0.3 mm.

7. The sound absorption plate of claim 4, wherein a cross-sectional area of the sound absorption metal thin film is equal to that of the sound absorption resonant cavity.

8. The sound absorption plate of claim 4, wherein the unit structure further comprises:

a sound sensor disposed on the ultramicropore sound absorption panel, wherein the sound sensor senses environmental sound waves and produces a corresponding detection signal; and a speaker, with a spectral analysis function, disposed on the ultramicropore sound absorption panel, wherein the speaker receives the detection signal and emits sound waves having an opposite phases and amplitudes to those of the environmental sound waves and thus the environmental sound waves can be cancelled out.

9. The sound absorption plate of claim 8, wherein the sound sensor is a SMD sound wave piezoelectric sensor, which converts sound wave pressure into an electrical signal transferred to the speaker.

10. The sound absorption plate of claim 9, wherein the speaker is a SMD piezoelectric speaker, which receives the electrical signal and analyses a spectrum of the environmental sound waves to emit the sound waves having opposite phases to those of the environmental sound waves.

11. The sound absorption plate of claim 8, wherein the speaker is a SMD piezoelectric speaker, which receives the detection signal and analyses a spectrum of the environmental sound waves to emit the sound waves having opposite phases to those of the environmental sound waves.

* * * * *